US007585062B2

(12) United States Patent
Momose

(10) Patent No.: US 7,585,062 B2
(45) Date of Patent: Sep. 8, 2009

(54) LIQUID EJECTING HEAD

(75) Inventor: Kaoru Momose, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 404 days.

(21) Appl. No.: 11/275,253

(22) Filed: Dec. 20, 2005

(65) Prior Publication Data

US 2006/0109319 A1 May 25, 2006

Related U.S. Application Data

(62) Division of application No. 10/606,940, filed on Jun. 27, 2003, now Pat. No. 7,004,570.

(30) Foreign Application Priority Data

Jun. 27, 2002 (JP) ..... 2002-188608
Jun. 27, 2002 (JP) ..... 2002-188609

(51) Int. Cl.
*B41J 23/00* (2006.01)

(52) U.S. Cl. ..... 347/71; 347/68; 347/70

(58) Field of Classification Search ..... 347/68–71, 347/40, 43

See application file for complete search history.

(56) References Cited

U.S. PATENT DOCUMENTS 6,109,736 A 8/2000 Miyata et al.
6,749,292 B2 6/2004 Sturgeon et al.
6,811,238 B2 * 11/2004 Shingyohuchi ..... 347/11

FOREIGN PATENT DOCUMENTS

| | | | |
|---|---|---|---|
| JP | 05212860 | A | 8/1993 |
| JP | 09085945 | A | 3/1997 |
| JP | 10107397 | A | 4/1998 |
| JP | 10305578 | A | 11/1998 |
| JP | 11320871 | A | 11/1999 |
| JP | 200043258 | A | 2/2000 |
| JP | 2000198195 | A | 7/2000 |
| JP | 200286713 | A | 3/2002 |
| JP | 2002211129 | A | 7/2002 |

* cited by examiner

*Primary Examiner*—Lamson D Nguyen
(74) *Attorney, Agent, or Firm*—Sughrue Mion, PLLC

(57) ABSTRACT

A liquid ejecting head includes a passage unit, having a nozzle opening, a pressure generating chamber communicating with the nozzle opening, and a reservoir holding a liquid to be supplying to the pressure generating chamber, a head case on which the passage unit is attached, a pressure generating element for applying variance of pressure to the pressure generating chambers, accommodated in a space defined in the head case, and a head substrate closing an opening of the space of the head case. An air sealing member is disposed between the head case and the head substrate.

10 Claims, 8 Drawing Sheets

LIQUID EJECTING HEAD

This is a divisional of application Ser. No. 10/606,940 filed Jun. 27,2003. The entire disclosure of the prior application Ser. No. 10/606,940 is hereby incorporated by reference.

BACKGROUND OF THE INVENTION

The present invention relates to a liquid ejecting head which ejects liquid droplets from nozzle openings by vibration of pressure generating elements.

The liquid ejecting head provided with the pressure generating elements is known in those of dealing with various kinds of liquids, and among of them, typical may be a recoding head employed in an ink jet-recording apparatus. Therefore, a recording head of the ink jet-recording apparatus as one example of the related liquid ejecting head will be described according to FIGS. 8 and 9 of the attached drawings.

The recording head includes a passage unit 1 having nozzle openings 2 and a head case 9 to be attached with the passage unit 1.

The passage unit 1 is composed by laminating a nozzle plate 3 provided in row with the nozzle openings 2 in a nozzle forming face 3A, a passage substrate 5 provided in row with pressure generating chambers 4 communicating with the respective nozzle openings 2, and a vibrating plate 6 for closing the lower openings of the pressure generating chambers 4. The passage substrate 5 is formed with ink reservoirs 8 which communicate with the respective pressure generating chambers 4 via ink passages 7, and hold an ink to be flowed to the pressure generating chambers 4. incidentally, the whole of the recording head is shown with a mark of H.

The head case 9 served as a base material of the recording head H is formed by injection molding of a thermosetting resin or a thermoplastic resin, and has spaces being vertically extending. The spaces accommodate pressure generating elements 11. The pressure generating elements 11 are fixed to fixing substrates 12 by lower ends thereof being attached to the head case 9. And front end faces of the pressure generating elements is fixed to island portions 6A at an under face of the vibrating plate 6.

A plurality of pressure generating chambers 4, pressure generating elements 11, and nozzle openings 2 are arranged in a perpendicular direction with respect to the sheet surface of FIG. 9. That is, in this example, a nozzle arrangement is formed in two rows, such that the same kind of ink is ejected from each row of the nozzles as one unit.

The pressure generating elements 11 are connected to conducting wires 13 for input respectively, as shown in FIGS. 8 and 9. Each conducting wire 13 is connected to a printed wiring 15 on the head substrate 14 through each through hole 14A of the head substrate 14. The printed wiring 15 is made intensive and connected to a flexible flat cable 17 through a connector 16. The flexible flat cable 17 is connected to a drive circuit (not shown). When a drive signal from the drive circuit is input to the pressure generating elements 11, the pressure generating elements 11 are caused to be expanded and contracted in longitudinal directions to change pressure in the pressure generating chambers 4, whereby the ink in the pressure generating chambers 4 is ejected as ink drops from the nozzle openings 2. Incidentally, the through holes 14A are filled with the inserted conducting wires 13 so that the through holes has almost no spaces, but for easily seeing air flowing condition thereabout, dimensions of the through holes 14A are illustrated by exaggeration.

On the other hand, damper recesses 18 for escaping pressure fluctuation in the ink reservoirs 8 in ejecting the ink through the vibrating plate 6 is formed at parts of the head case 9 corresponding to the ink reservoirs 8. The vibrating plate 6 is made of polyphenylene sulfide film (called as "PPS film" hereafter). When the damper recesses 18 are formed as independent spaces being not communicating with an outside, the air in the damper recesses 18 penetrates through the vibrating plate 6 made of PPS film and emerges into the ink, so that an air pressure in the damper recesses 18 is dropped, and tension of the vibrating plate 6 is rose, and sufficient damper effect cannot be provided. Therefore, outside communication passages 19 are bored directing from the bottom of the damper recess 18 toward an opposite side of the head case 9 for the damper recesses 18 to communicate with the outside in order to prevent reduction of the pressure in the damper recess 18.

However, since an opening area of the damper recess 18 is large, an area of the vibrating plate 6 covering the opening area is also large accordingly, and in particular, while the ink jet-recording apparatus is at rest, a water content in the ink is evaporated and passes through the vibrating plate 6 having the wide area into the damper recesses 18, and the vapor is released in an atmosphere via the outside communication passages 19 in accordance with increase of the pressure. Owing to such phenomenon, the water content in the ink decreases and viscosity of the ink increases, and when the apparatus is used after some later, an obstacle occurs in ejection of proper ink drops.

Then, for decreasing evaporation of the water content in the ink as fast as possible, the outside-communication passages 19 are formed with parts of small flowing area, otherwise passage shapes are formed with bent parts having large flowing resistance so as to restrain the water evaporation while functioning the damper.

In the above related apparatus, some measures are taken to the parts of the damper recesses 18. However, as shown in FIG. 9B, the vapor passes the vibrating plate 6 effected with displacement in vibration of the pressure generating elements 11, that is, passes vibration displacing parts 6B of the vibrating plate 6 positioning around island portions 6A, is released from the spaces 10 into the atmosphere through slight gaps created in face-contacting parts between the head substrate 14 and the head case 9 or through the through holes 14A. Accordingly, for decreasing evaporation of the water content in the ink as fast as possible, it is necessary to suppress the vapor passing the vibration displacing parts 6B from releasing into the atmosphere.

The vapor of the liquid passing through the vibration displacing parts 6B is a vapor of the liquid itself, or a vapor of specific components in the liquid. Even if the vapor is any one of both, it spoils the liquid or hinders maintenance of normal composition of the liquid.

SUMMARY OF THE INVENTION

It is therefore an object of the present invention to provide a liquid ejecting head which suppresses evaporation of the liquid or some component of the liquid through the part of the vibrating plate which is effected with pressure fluctuation of the pressure generating elements.

In order to achieve the above object, according to the present invention, there is provided a liquid ejecting head comprising:

a passage unit, having a nozzle opening, a pressure generating chamber communicating with the nozzle opening, and a reservoir holding a liquid to be supplying to the pressure genera ting chamber;

a head case, on which the passage unit is attached;

a pressure generating element for applying variance of pressure to the pressure generating chambers, accommodated in a space defined in the head case; and a head substrate, closing an opening of the space of the head case, wherein an air sealing member is disposed between the head case and the head substrate.

That is to say, the liquid ejecting head of the invention is provided with the air sealing member between the head case and the head substrate.

In the above configuration, since slight gaps in the face-contacting parts between the head case and the head substrate are perfectly sealed by the air sealing member, the space of the head case communicating with the vibrating plate is sealed by the presence of the air sealing member. Accordingly, if the liquid or some component existing in the liquid, for example, the water content penetrates the vibrating plate under the condition of the vapor, and becomes saturated in the sealed spaces to heighten the vapor pressure, the vapor is restrained from more invasion into the spaces, and the liquid or some component existing in the liquid is stopped to a minimum decreasing amount, so that it is possible to hold change in the liquid composition to be substantially harmless level. In particular, since the face-contacting parts between the head case and the head-substrate are finished to be flatness at high precision in both contacting surfaces, although even minute gaps are created in the face-contacting parts owing to dispersion in precision of parts or roughness in surface, a perfect seal is realized by the air sealing member and the face-contacting parts are useful also in maintaining precision in parts.

Preferably, the air sealing member is disposed between a sealing end face being opposed to a passage unit side of the head case and the head substrate.

In the above configuration, the sealing end face can be finished to be flat for sealing as easy as possible, otherwise a face suitable to a face shape of the head substrate, and the air sealing member can be effected under a condition of good sealing property with excellent air sealing.

Preferably, the air sealing member is disposed so as to surround a periphery of the openings of the head.

In the above configuration, the air sealing member at the face-contacting parts between the head case and the head substrate encircles the surrounds of the openings of the spaces and functions the air sealing under a so-called endless condition, the vapor filled in the spaces does not leak outside from the face-contacting parts.

Preferably, the air sealing member is comprised of a low elastic material.

In the above configuration, elasticity of the substance is at a low level, when the low elastic substance is pressed between the head case and the head substrate, moderate elastic reaction is obtained suitably to interrupt the vapor passing. In other words, for example, to a pressure of the vapor evaporated at room temperature, optimum is to interrupt with the low elastic substance. Further, since the elastic reaction when the low elastic substance is pressed is very low, the head case or especially the head substrate can be prevented from deformation.

Here, it is preferable that, the low elastic material is a gel material.

In the above configuration, the elasticity suited by the gel material or a soft condition without viscosity or fluidity are available, if surrounding circumferential temperature or moisture are varied or external force such as vibration caused during transportation is loaded, the low elastic substance is less fluidized or destroyed, enabling to maintain the function as the air sealing member.

Here, it is preferable that, the air sealing member is a molded elastic part.

In the above configuration, it is sufficient to only place the molded elastic part between the sealing end and the head substrate, a setting-up work of the liquid ejecting head is simplified. Besides, being the molded part, dimensional precision of the part can be in advance exactly determined, so that the sealing condition between the sealing end and the head substrate may be secured.

Here, it is preferable that, the air sealing member is an elastic sealing material having semi-fluidity.

In the above configuration, this elastic sealing material may be coated at desired portions of the sealing end or the head substrate, so that the air sealing member may be placed at most preferable portions for keeping the air sealing. Since the elastic sealing material is given the semi-fluidity, if the pressure is exerted between the sealing end and the head substrate, the elastic sealing material is moderately expanded to widen an adhesion area with the sealing end thereof or the head substrate. This is desirable to function the air sealing.

Preferably, an opening through which a conducting wire is passed is formed on the head substrate, and the opening of the head substrate is sealed.

In the above configuration, the spaces in the passing opening parts are perfectly sealed, the vapor is perfectly sealed in addition to the maintenance of the air sealing between the head case and the head substrate.

Preferably, a through hole for leaking a gas formed on the head substrate is sealed by a sealing treatment.

In the above configuration, the function of keeping the air sealing of the head substrate itself is secured, it is possible to bring the release of the vapor as a whole of the liquid ejecting head to a substantial harmless level. Although the air-tight quality of the head substrate itself is enough secured, there might be a slight probability of causing through-holes. If the sealing treatment is done to close such through-holes, the air sealing of a higher degree is realized.

Preferably, the liquid ejecting head is served for an ink jet recording apparatus.

In the above configuration, even if the ink jet-recording apparatus is at rest for a long time, the water content in the ink is not rapidly decreased, and when using the apparatus after rest, the ink droplets are normally ejected.

Preferably, a groove is formed on either the head case or the head substrate, and the air sealing member is disposed in the groove.

Here, it is preferable that, a protrusion is formed on either the head case or the head substrate so that the protrusion is opposed to the groove formed on other one of either the head case or the head substrate, and the air sealing member disposed in the groove is crushed by the protrusion.

According to the present invention, there is also provided a liquid ejecting head, comprising:

a passage unit, having a nozzle opening, a pressure generating chamber communicating with the nozzle opening, a reservoir holding a liquid to be supplying to the pressure generating chamber, and a vibrating plate closing openings of the pressure generating chamber and the reservoir;

a head case, on which the passage unit is attached; and a pressure generating element for applying variance of pressure to the pressure generating chambers, accommodated in a space defined in the head case, wherein an air sealing member is disposed between the head case and the pressure generating element so as to form a space portion defined between the vibrating plate and the air sealing member.

That is to say, the liquid ejecting head of the invention is provided with the air sealing member between the head case and the pressure generating element, and defined with space portions between the vibrating plate and the air sealing member.

In the above configuration, the space portion between the vibrating plate and the air sealing member is substantially closed space owing to the presence of the air sealing member. Accordingly, if the liquid or some component existing in the liquid, for example, the water content penetrates the vibrating plate under a condition of a vapor, and becomes saturated in the sealed space portions to heighten the vapor pressure, the vapor is restrained from more invasion into the space portions. By the restraining actuation, the liquid or some component existing in the liquid is stopped to a minimum decreasing amount, so that it is possible to hold change in the liquid composition to be substantially harmless level. Further, by the formation of the space portions, the air sealing members do not adhere to the vibrating plate, so that vibration of the vibrating plate is not hindered, and liquid droplets are normally ejected.

Preferably, a plurality of pressure generating elements are accommodated in the space of the head case.

In the above configuration, the space portion formed by the existence of the air sealing member create a condition of encircling surrounds of the respective pressure generating elements, enabling to enlarge the capacity of the space portion. Change in internal pressure of the space portion goes down with respect to displacement in vibration of the vibrating plate, so that vibration of the vibrating plate is not hindered, and liquid droplets are normally ejected.

Preferably, the pressure generating element has an elongated shape in which a longitudinal direction thereof is parallel to a vibrating direction of the vibrating plate.

Preferably, it is possible to secure the length of the space between the pressure generating element and the head case to be lengthy along the vibrating direction of the vibrating plate, and in company with this effect, the space for disposing the air sealing member is also lengthened, and if the air sealing member is made by, e.g., pouring, it is possible to securely pour the air sealing members and make the space portions sealed, so that workability is good, restraining percent defective to be low. If making long the space length of arranging the air sealing members, it is possible to exactly form the space portions between the vibrating plate and the air sealing members, and to determine the space capacity of the space portions to be large.

Preferably, a space portion between an inside face of the space in the head case and the pressure generating element is formed to be narrow toward the side of the vibrating plate.

In the above configuration, the air sealing member may be placed at a part of the space being narrow, and the air sealing member may be stably placed by the narrow space. Since the vibrating plate is narrow in the space, the air sealing member is difficult to reach the vibrating plate preferably to secure the space portion.

Here, it is preferable that, the air sealing member is disposed at a part of the space portion which becomes narrower.

In the above configuration, the air sealing member is arranged at the part where the space becomes narrow as approaching the vibrating plate, that is, at the space portion being rapidly narrow, the arranging place of the air sealing member may be set uniformly, and the precision of a part in the liquid ejecting head is improved. If the air sealing member is made by, e.g., pouring into between the pressure generating element and the head case, when the poured air sealing member moves toward the vibrating plate, and stops as being pushed at the part making the spaces narrower, so that the pouring work may be simplified, restraining percent defective to be low.

Preferably, the air sealing member is comprised of a low elastic material.

In the above configuration, the air sealing member is closely adhered to the pressure generating element or the head case with moderate elasticity deforming stress of the pressure generating element is escaped, and change in vibration characteristic of the pressure generating element itself is avoided, while the air sealing is functioned favorably. The air sealing member influences the light elasticity to the pressure generating element and the head case, so that the position of the air sealing member is not deviated and the air-tight function is provided with high durability.

Here, it is preferable that, the low elastic material is a gelled material.

In the above configuration, the elasticity suited by the gelled material or a soft condition without viscosity or fluidity are available, if stress is loaded by repeating vibration of the pressure generating elements, the low elastic substance is less fluidized or destroyed, enabling to maintain the function as the air sealing member.

Preferably, the air sealing member has insularity.

In the above configuration, when the pressure generating element is formed with a piezoelectric element having electrodes and the air sealing members are adhered to the pressure generating elements, since the insularity can be secured the pressure generating element can be normally worked. In addition, any especial insulation treatment is not performed to the pressure generating element itself, thereby enabling to avoid useless cost-up.

Preferably, the liquid ejecting head is served for an ink jet recording apparatus. In the above configuration, even if the ink jet-recording apparatus is at rest for a long time, the water content in the ink is maintained to avoid increasing of viscosity, and when using the apparatus after rest, the ink droplets are normally ejected.

BRIEF DESCRIPTION OF THE DRAWINGS

The above objects and advantages of the present invention will become more apparent by describing in detail preferred exemplary embodiments thereof with reference to the accompanying drawings, wherein:

FIG. 4A is a plan view thereof, while FIG. 4B is a cross sectional view thereof;

FIG. 5A is a cross sectional view, while FIG. 5B is an enlarged cross sectional view:

FIGS. 9A and 98 are views showing the related example, and FIG. 9A is a cross sectional view thereof, while

DETAILED DESCRIPTION OF THE PREFERRED EMBODIMENTS

A liquid ejecting head according to a first embodiment and a second embodiment of the invention will be explained in detail.

The liquid ejecting head of the invention deals with various kinds of liquids as mentioned above, and may serve the functions, and the illustrated practiced embodiments exemplify the application of the present liquid ejecting head to the ink jet-recording apparatus as a typical example.

Figure 8:
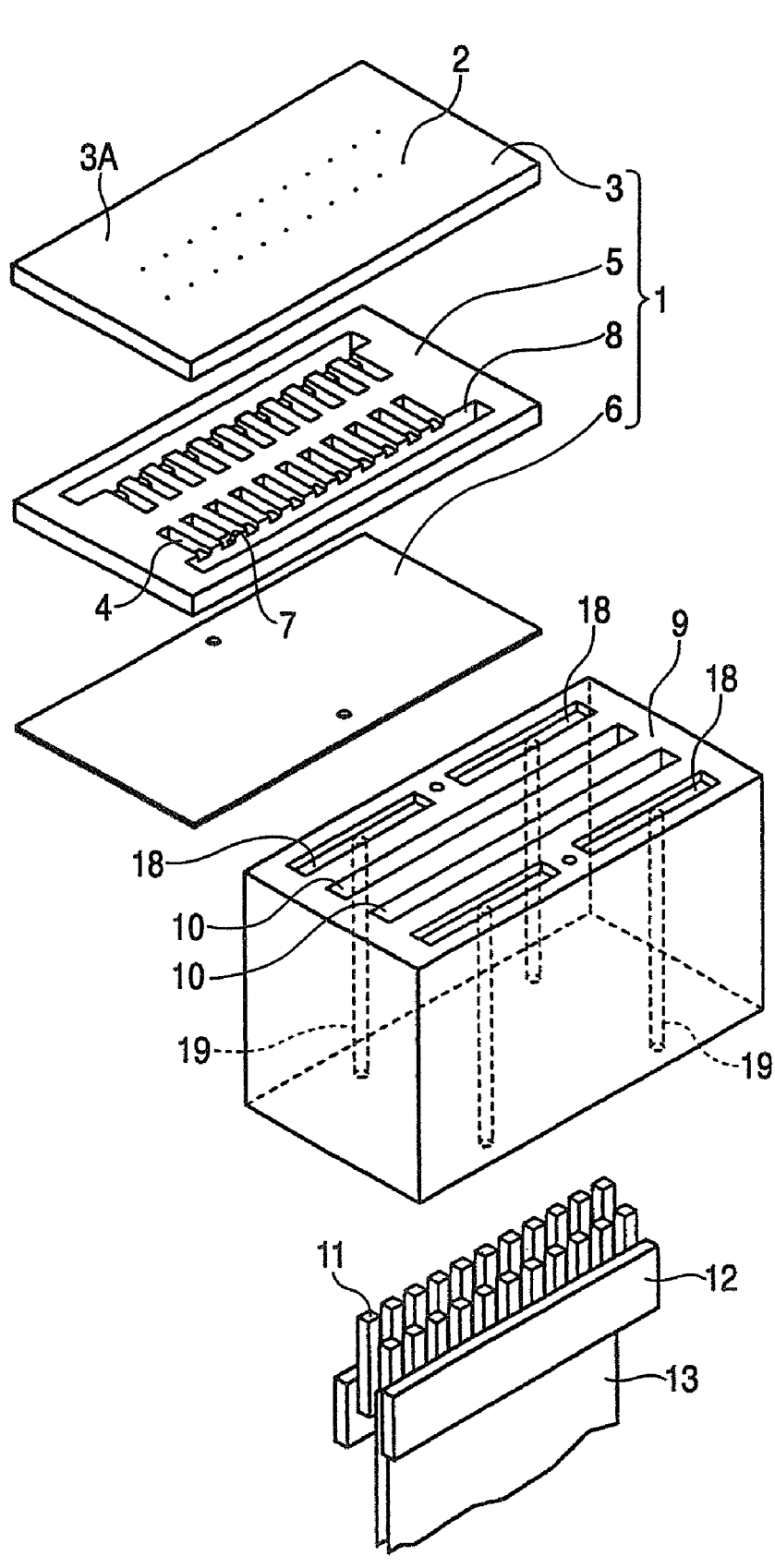
FIG. 8 is a perspective views of disassembling the related example.
Figure 9A:
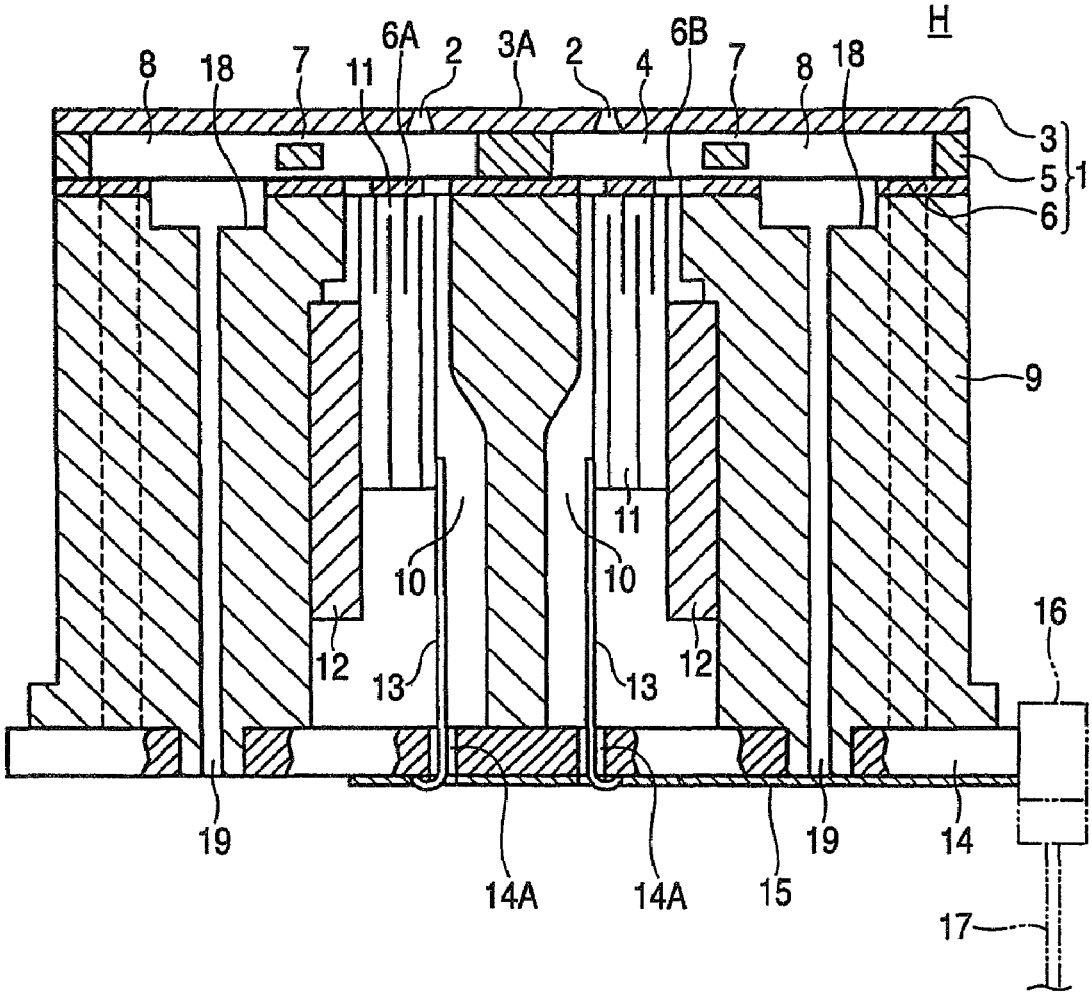
Figure 9B:
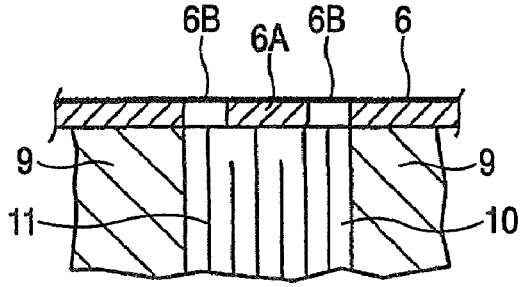
FIG. 9B is an enlarged cross sectional view thereof.

FIGS. 1 to 4 are views showing a liquid ejecting head according to the first embodiment of the invention. Further, the same reference numerals and marks are attached to portions similar to those of the recording head H explained in FIGS. 8 and 9.

This recording head 11 includes the passage unit 1 having the nozzle openings 2 and the head case 9 to be attached with the passage unit 1.

The passage unit 1 is composed by laminating a nozzle plate 3 provided in row with the nozzle openings 2 in a nozzle forming face 3A, a passage substrate 5 provided in row with pressure generating chambers 4 communicating with the respective nozzle openings 2, and a vibrating plate 6 for closing the lower openings of the pressure generating chambers 4. The passage substrate 5 is formed with ink reservoirs 8 which communicate with the respective pressure generating chambers 4 via ink passages 7, and hold an ink to be flowed to the pressure generating chambers 4. incidentally, the whole of the recording head is shown with a mark of H.

The head case 9 served as a base material of the recording head H is formed by injection molding of a thermosetting resin or a thermoplastic resin, and has spaces being vertically extending. The spaces accommodate pressure generating elements 11. The pressure generating elements 11 are fixed to fixing substrates 12 by lower ends thereof being attached to the head case 9. And front, end faces of the pressure generating elements is fixed to island portions 6A at an under face of the vibrating plate 6.

Figure 1:
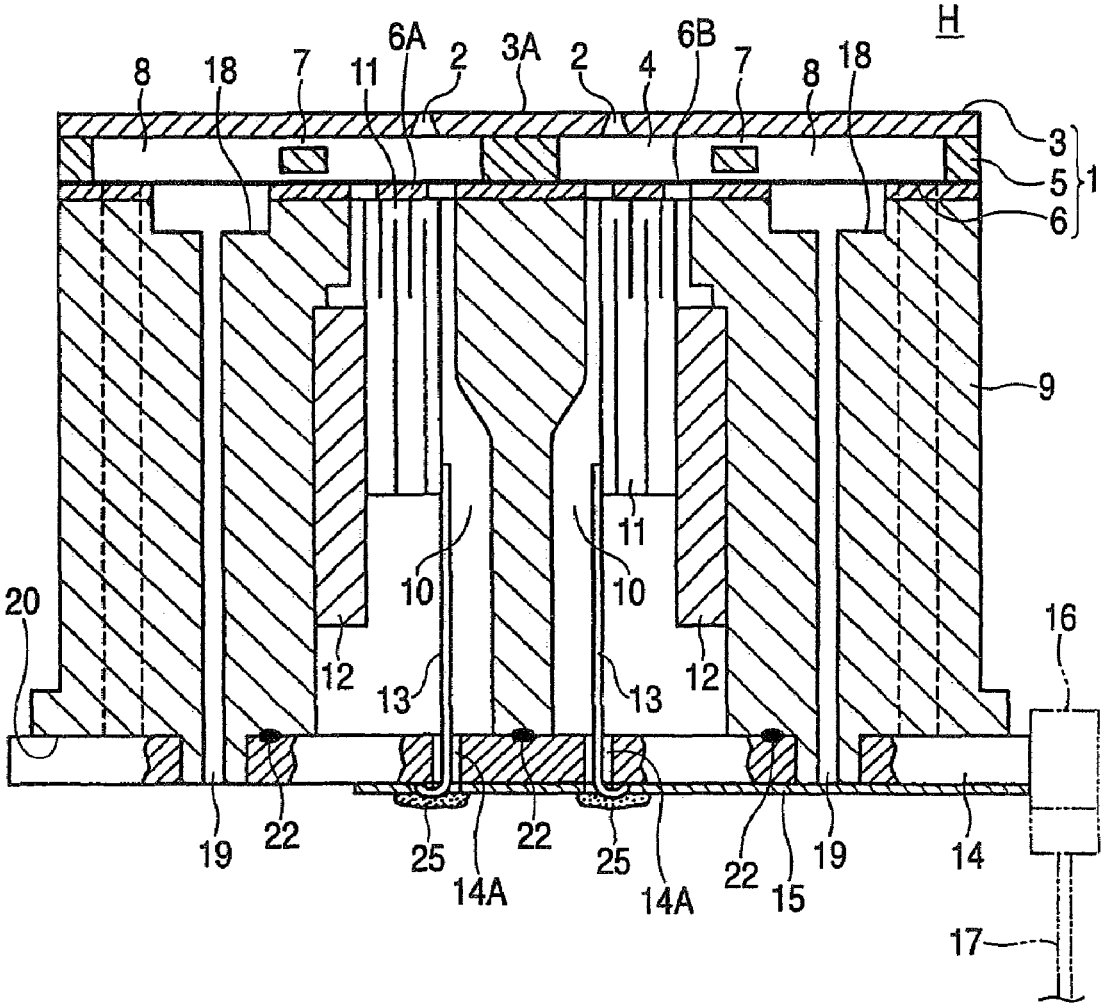
FIG. 1 is a view showing the liquid ejecting head of one embodiment of the invention.

A plurality of pressure generating chambers 4, pressure generating elements 11, and nozzle openings 2 are arranged in a perpendicular direction with respect to the sheet surface of FIG. 1. That is, in this example, a nozzle arrangement is formed in two rows, such that the same kind of ink is ejected from each row of the nozzles as one unit.

A piezoelectric vibrator of vertically vibrating mode is used as the pressure generating elements 11. The pressure generating element 11 has electrode materials and piezoelectric materials which are alternately laminated in a direction perpendicular to the longitudinal direction thereof, that is, the vibrating direction of the vibrating plate 6.

The pressure generating elements 11 are connected to conducting wires 13 for input respectively, as shown in FIG. 1. Each conducting wire 13 is connected to a printed wiring 15 on the head substrate 14 through each through hole 14A of the head substrate 14. The printed wiring 15 is made intensive and connected to a flexible flat cable 17 through a connector 16. The flexible flat cable 17 is connected to a drive circuit (not shown). When a drive signal from the drive circuit is input to the pressure generating elements 11, the pressure generating elements 11 are caused to be expanded and contracted in longitudinal directions so as to vibrate the vibrating plate 6 so that pressure in the pressure generating chambers 4 is changed, whereby the ink in the pressure generating chambers 4 is ejected as ink drops from the nozzle openings 2. Incidentally, the through holes 14A are filled with the inserted conducting wires 13 so that the through holes has almost no spaces, but for easily seeing air flowing condition thereabout, dimensions of the through holes 14A are illustrated by exaggeration.

At the part opposite to the passage unit 1 of the head case 9, the sealing end face 20 is formed, which is finished at flatness of high degree. The head substrate 14 in flat shape is closely attached to the sealing end face 20. A structure for attaching the head substrate 14 to the head case 9 is not shown, but a screwing manner is one example thereof. In such a way, the face-contacting parts between the sealing end face 20 and the head substrate 14 are formed.

Also, damper recesses 18 for escaping pressure fluctuation in the ink reservoirs 8 in ejecting the ink through the vibrating plate 6 is formed at parts of the head case 9 corresponding to the ink reservoirs 8. The vibrating plate 6 is made of polyphenylene sulfide film (called as "PPS film" hereafter).

Figure 2:
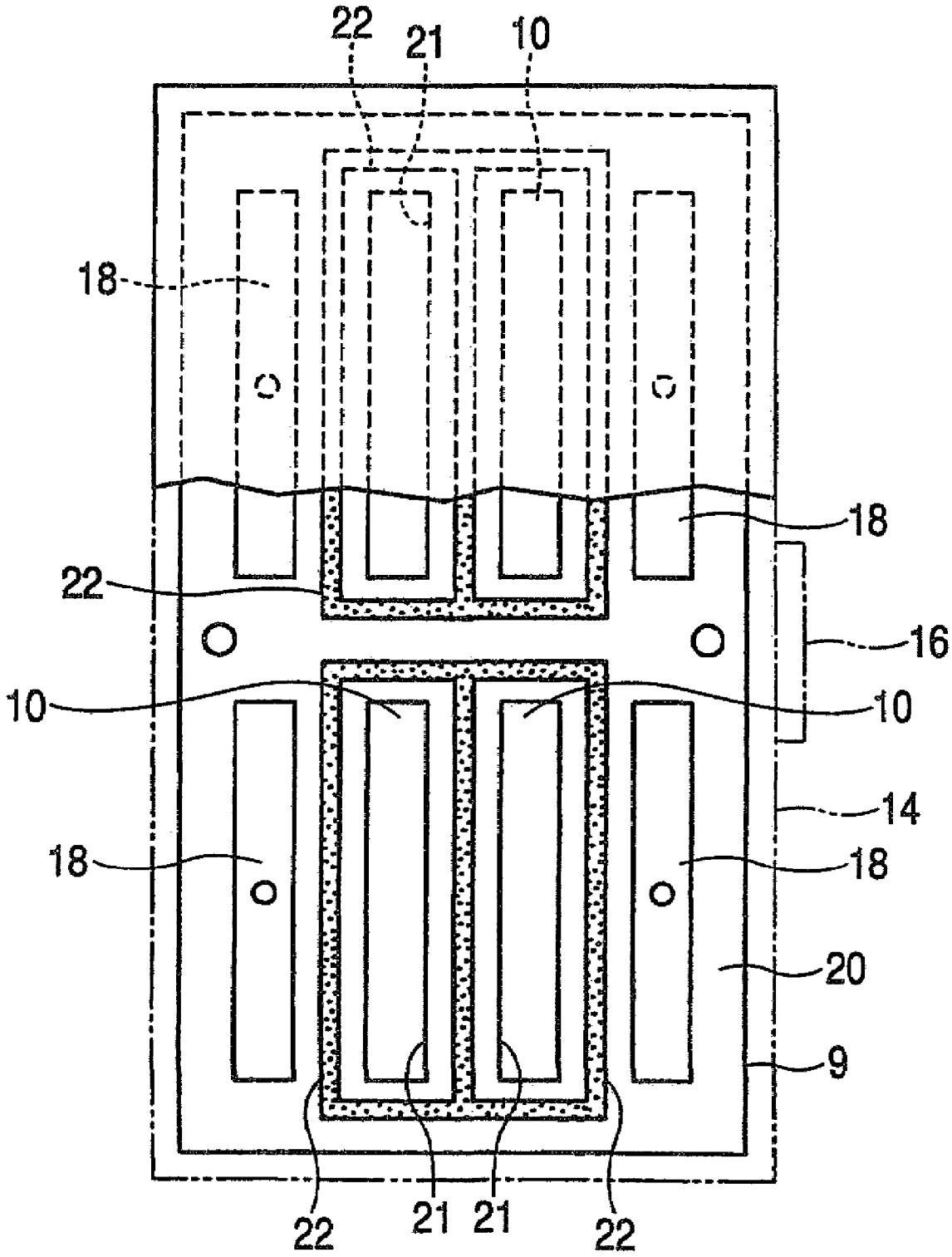
FIG. 2 is a plan view seeing the liquid ejecting head of the invention from the head substrate.

The spaces 10 accommodating a plurality of pressure generating elements 11 therein is opened toward the sealing end face 20, and numeral 21 designates the openings. The air sealing member 22 are interposed between the sealing end face 20 of the head case 9 and the head substrate 14 so as to surround the peripheral of openings. The air sealing member 22 encircles as endless the surrounds of the openings 21, and are embodied as narrow lines in FIG. 2. Incidentally, the air sealing members 22 is shown in FIG. 1 as Parts in black. FIG. 2 shows the air sealing members which surround the openings 21 in two rows. However, a part of the air sealing member between both openings 21 may be omitted.

The air sealing member 22 is preferably the low elastic material such as silicone rubber, adhesives or foamed materials, more preferably a gelled silicone gel. As the air sealing member 22, suited are such substances having properly low elasticity, viscosity, or small coefficient of thermal expansion.

As embodiments of displacing the air sealing member 22, various modifications are applicable as exemplified in FIG. 3. Those shown in FIGS. 3A and 3B are the molded elastic materials as a synthetic rubber, where FIG. 3A shows an example of O-ring like cross sectional shape, FIG. 3B is a packing shape in thin sheet, and oblong windows are formed in correspondence to the openings 21.

Figure 3A:
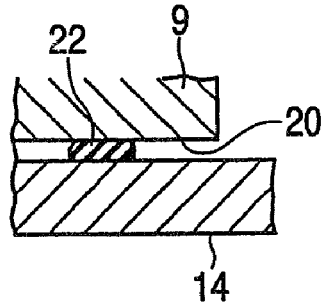
FIG. 3A through 3E are views showing the five examples of interposing the air sealing member.
Figure 3B:
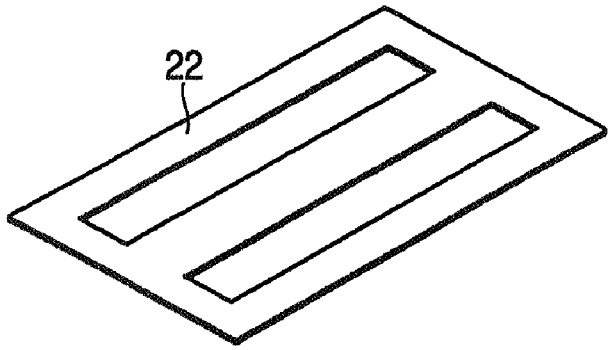
Figure 3C:
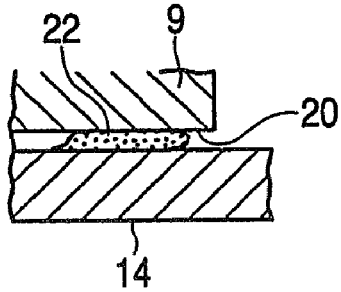
Figure 3D:
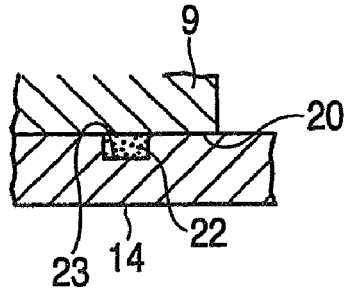
Figure 3E:
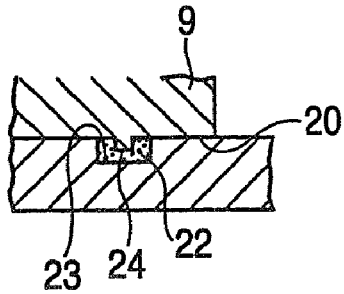

FIGS. 3C, 3D and 3E shows the air sealing member 22 having the semi-fluidity as a butyl rubber are interposed. FIG. 3C shows that the air sealing member 2 is coated on at lease one of the sealing end face 20 and the head substrate 14 through a coating nozzle so as to surround the periphery of the opening 21, and the air sealing member 22 is crushed.

FIG. 3D shows that a groove 23 is formed in the head substrate 14 so as to surround the periphery of the opening 21. The groove 23 is filled with the air sealing member 22 of the semi-fluidity via a pouring nozzle, and the sealing end face 20 is firmly adhered. By the way, the groove 23 may be formed in the head case 9 or in both of the head case 9 and the head substrate 14.

Further, FIG. 3E shows that a protrusion 24 is applied to the embodiment of FIG. 3D for increasing the air sealing. The protrusion 24 is formed in the sealing end face 20. As shown in the same, since the protrusion 24 is urged in the air sealing member 22 within the groove 23, the air sealing member 22 is pressed closely to the inside face of the groove 23, the surface of the protrusion 24, and the sealing end face 20, so that the air sealing function is securely accomplished.

As mentioned above, the air sealing member 22 interposed between the head case 9 and the head substrate 14 for preventing the vapor of the ink having passed through the vibration displacing part 6B from releasing into the atmosphere. When the vapor becomes saturated in the closed space 10 and the steam pressure is heightened, the vapor no more penetrates the vibration displacing part 6B, and the water content in the ink is restrained from evaporation.

Figure 4A:
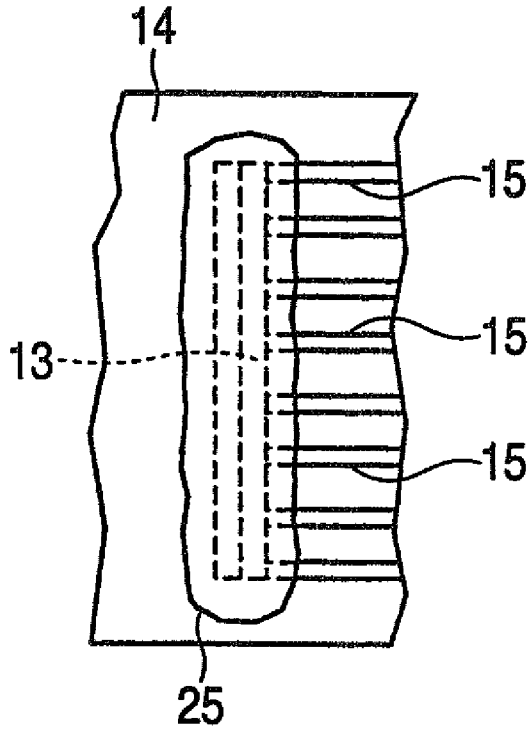
FIGS. 4A and 4B are views showing the embodiments where the conducting wires are positioned at the passing portions.
Figure 4B:
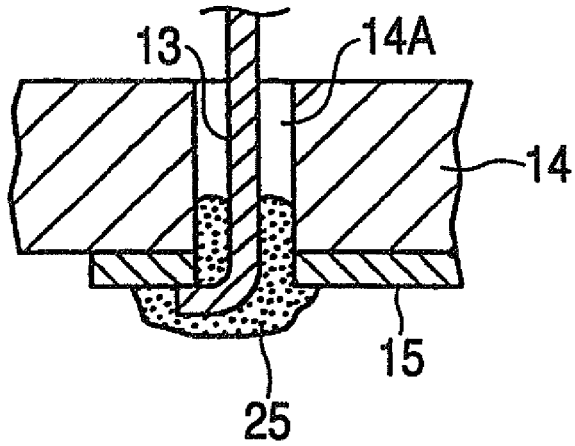

FIG. 4 shows the air sealing state at the part where the conducting wire 13 passes through the passing hole 14A. In the same, as mentioned above, the space between the passing hole 14A and the conducting wire 13 is shown by exaggeration. The sealing material 25 as the low elastic substance composed of the synthetic resin material as silicone gel is filled in the passing hole 14A. The sealing material 25 covers connections between the conducting wires 13 and the printed wiring, and a part of the printed wiring, or invades into the interior of the passing hole 14A, thereby to keep the air sealing at the passing portion of the conducting wire 13.

The sealing material 25 is coated at desired parts through the coating nozzle similarly to the air sealing member 22. However, instead of this practice, a molding system may be employed. That is, the portion of the passing hole 14A is set onto the forming mold, and the sealing material 25 is poured thereinto to provide the air sealing in the passing part of the conducting wire 13. As for the sealing material 25, the same composition as that of the air sealing member 22 may be used.

As mentioned above, the sealing material 25 disposed at the part where the conducting wire 13 passes the passing hole 14A functions the air sealing together with the air sealing member 22, thereby to prevent the vapor of the ink haying passed through the vibration displacing part 6B from releasing into the atmosphere. When the vapor becomes saturated in the closed space 10 and the steam pressure is heightened, the vapor no more penetrates the vibration displacing part 6B, and the water content in the ink is restrained from evaporation.

The head substrate 14 is sometimes formed with the through holes for connecting electrodes between layers when patterns are formed on both faces of the head substrate 14, or a circuit is formed as laminated patterns. If performing a sealing treatment to close the through holes, the function of the air sealing of the head substrate itself is secured more surely, so that it is possible to bring the release of the vapor as a whole of the recording head to the substantial harmless level. The above mentioned sealing treatment may be carried out by coating the surface of the head substrate 14 with a high polymer material, such as a silicone gel having an excellent viscoelasticity, otherwise by potting the portion of the through holes.

Next, the second embodiment of the invention will be described with reference with FIGS. 5 through 7. In this embodiment, an air sealing member is arranged between the head case and the pressure generating element. Further, in this embodiment, the same notations are attached to portions similar to those of the first embodiment, and a detailed explanation thereof will be omitted.

The pressure generating element 11 is shaped to be lengthy in the vibrating direction of the vibrating plate, i.e., in expanding and contracting directions. Spaces 21 are formed between the pressure generating elements 11 and the inside faces 20 of the head case 9 opposing one sides of the pressure generating elements 11 so that the space 21 at side of the vibrating plate is narrow. In parts where the spaces 21 become narrower, inclined faces 23 are formed in the inside faces 20.

On the other hand, spaces 25 are formed at the opposite side to the inside face 20 between the inside face 24 of the head case 9 and the pressure generating element 11. FIG. 7 is a plan view showing a state arranging the spaces 21 and 25, and since a plurality of pressure generating elements 11 are accommodated in the supporting spaces 10, spaces 26 are formed between the adjoining pressure generating elements 11 in addition to said spaces 21, 25. As above mentioned, since the pressure generating element 11 is lengthy along the vibrating direction of the vibrating plate 6, the length of the space between the pressure generating element 11 and the head case 9 may be lengthened in the vibrating direction of the vibrating plate 6, so that, in company with this, the space for supporting the air sealing members 27 is also lengthened, and in case the air sealing members 27 is produced by, e.g., pouring, the pouring may be exactly carried out so as to make the space 28 closed, and the working is good, enabling to control percent defective to be low. Further, When the space for disposing the air sealing members 27 is longer, the sealing member 27 between the vibrating plate 6 and the air sealing members 27 can be exactly formed, and the capacity of the space portion 28 may be determined to be large. The lengthy spaces 21, 25 and 26 are formed for easily producing later mentioned air sealing members 27.

Figure 5A:
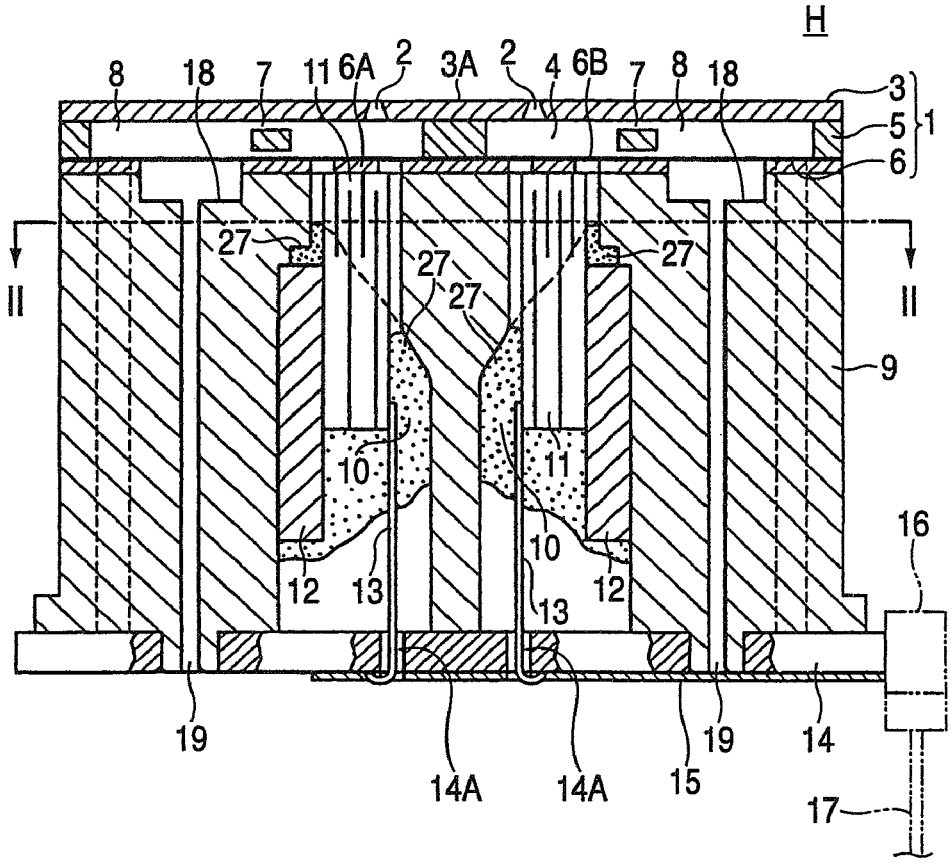
FIGS. 5A and 5B are views showing the liquid ejecting head of one embodiment of the invention.
Figure 5B:
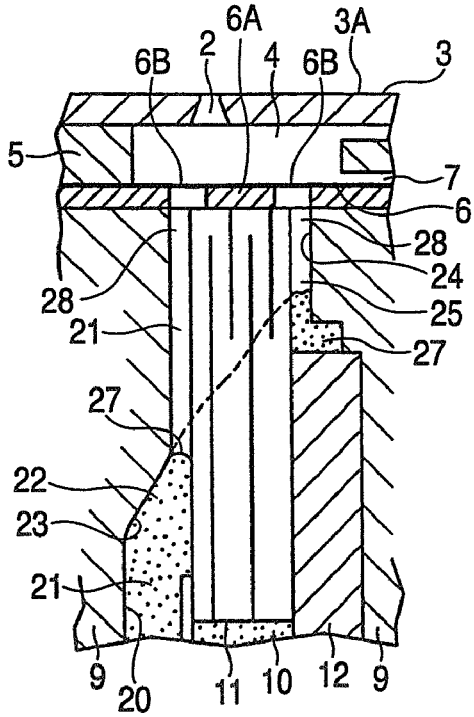
Figure 6:
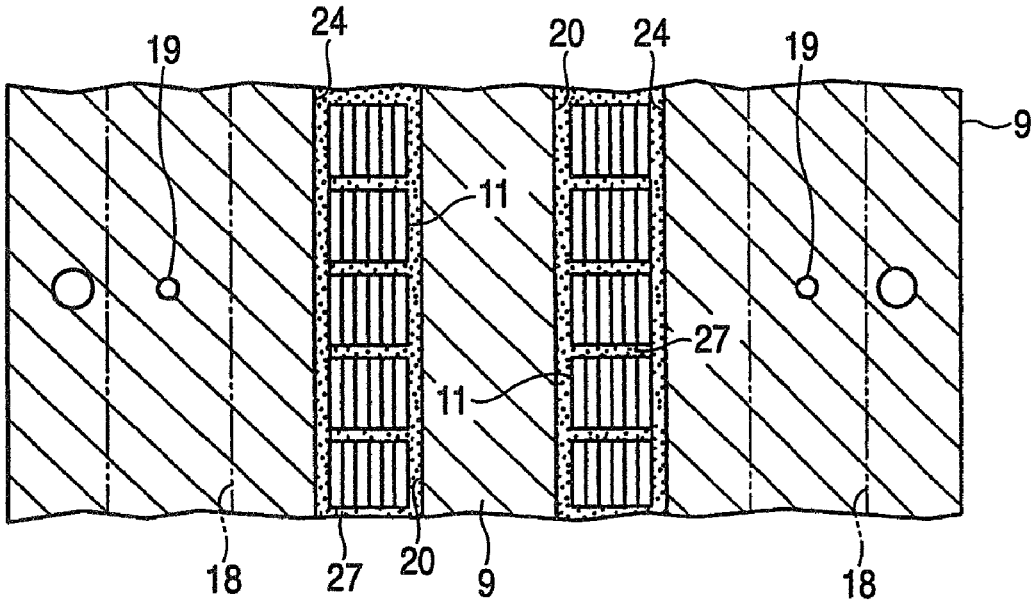
FIG. 6 is a cross sectional view along [2]-[2] of FIG. 5A.
Figure 7:
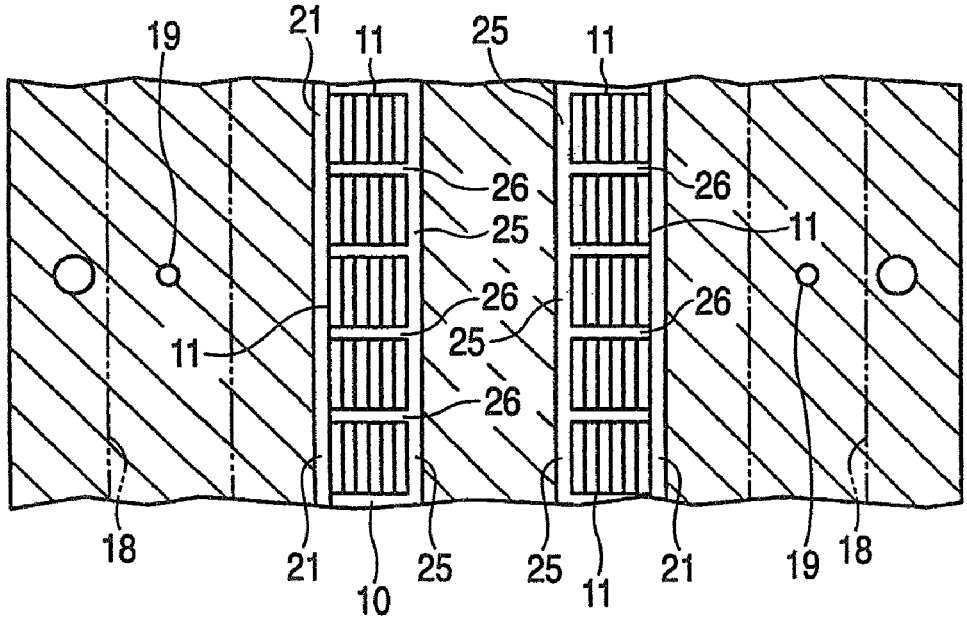
FIG. 7 is a cross sectional view showing spaces shown in the same manner of FIG. 6.

In FIGS. 5A, 5B and 6, the air sealing members 27 are shown as turning round also the upper space of a fixing substrate 12, but practically, being narrow in the passage spaces, the invasion of the air sealing member 27 into this portion might not reach all of the upper spaces corresponding to the pressure generating elements 11. It is accordingly preferable to arrange the air sealing members 27 under a condition of surrounding the fixing substrates 12, the pressure generating elements 11, and the conducting wires 13 as shown so as to bury the whole of the supporting spaces 10. By filling the air sealing members 27 in such a manner, the maintenance of the air sealing is perfect, and the space portions 28 having predetermined capacity may be secured.

The air sealing members 27 are disposed at spaces 21, 25 and 26 which are formed between the head case 9 and the pressure generating elements 11. The air sealing member 27 is preferably the low elastic material such as silicone rubber, adhesives or foamed materials, more preferably a gelled silicone gel. As for the air sealing member 27, suited are such substances having properly low elasticity, viscosity, or small coefficient of thermal expansion. Also depending on heating of the pressure generating element 11, suited are substances of viscosity being small and of non-fluidization. By disposing the air sealing members 27, the space portions 28 under the closed condition are formed between the vibrating plate 6 and the air sealing members 27.

Since the air sealing member 27 as mentioned above is closely adhered to the pressure generating element 11 and the head case 9 with moderate elasticity, deforming stress of the pressure generating element 11 is escaped and change in vibration characteristic of the pressure generating element 11 itself is avoided, while the air sealing is functioned favorably. The air sealing members 27 influence the light elasticity to the pressure generating elements 11 and the head case 9, so that the positions of the air sealing members 27 are not deviated and the air sealing function is provided with high durability. Further, since the gelled material gives the moderate elasticity and the plastic states without viscosity or fluidity, even if stress is loaded by repeating vibration of the pressure generating elements, the low elastic substance is less fluidized or destroyed, enabling to maintain the function as the air sealing member.

As a disposing method of the air sealing members 27 in the spaces 21, 25 and 26, a pouring method is taken up. When pouring the air sealing member 27 at the lower part of widening the intervals of the spaces 21 (see FIG. 5B), the air sealing member 27 is restrained in fluidization at the part of making narrower the distance of the air sealing member 27, and it does not move to the side of the vibrating plate 6 of the space 21 being narrow, but goes round the side of the space 26 and is held there or reaches till the space 25 and is held there. By behavior of the air sealing members 27, the pressure generating elements 11 are, as shown in FIG. 6, surrounded by the air sealing members 27. Under the condition of being surrounded, slight elasticity of the air sealing members 27 acts on the pressure generating elements 11 and the inside faces 20, 24, and the good air sealing may be provided without unhinging the serving characteristic of the pressure generating elements 11.

Further, similarly to the condition where the air sealing members 27 surround the pressure generating elements 11 as mentioned above, the space portions 28 have spaces shaped as surrounding the pressure generating elements 11 as shown in FIG. 5B, so that the capacity of the space portion 28 may be determined to be large. Also, when the vibration displacing portion 6B makes film vibration, the pressure of the space portion 28 is scarcely changed. Accordingly, the internal pressure of the space portion 28 slightly increases, and the closely adhered parts between the air sealing members 27 and the pressure generating elements 11 or with the inside faces 20, 24 do not remove off. At the same time, the vibration displacing portion 6B is not hindered in the vibrating actuation by change in the internal pressure of the space portions 28, either.

In the above mentioned pouring process, when the air sealing members 27 reach the parts 22 where the spaces become narrower, the fluidity in the parts 22 goes down owing to the viscosity of the air sealing members 27 and the air sealing members 27 go round the spaces 26. By such a flowing phenomenon, the air sealing members 27 always stay at said parts 22. Therefore, if the part 22 is placed, for example, as shown in FIG. 5B, it is possible to secure the space portions 28 where the air sealing members 27 do not reach the vibrating plate 6 (the vibration displacing portion 6B). When pouring, the air sealing members 27 are stopped at the parts 22 where the spaces become narrower, the workability is good, and percent defective is restrained to be low.

Since the space 21 is made narrow at the side of the vibrating plate 6, the air sealing members 27 may be positioned at the parts 22 where the spaces become narrower, and the air sealing members 27 may be stably disposed owing to the narrow spaces. Besides, the air sealing member 27 is difficult to reach the vibrating plate 6 (the vibration displacing portion 6B) suitably to securing of the space portions 28.

The air sealing members 27 interposed in the spaces 21, 25 and 26 as mentioned above prevent the vapor of the ink having passed through the vibration displacing part 6B from releasing into the atmosphere. When the vapor becomes saturated in the closed space portions 28 and the steam pressure is increased, the vapor no more penetrates the vibration displacing part 6B, and the water content in the ink is restrained from evaporation.

Since the air sealing members 27 have the insularity, even if the air sealing members 27 are adhered to the pressure generating elements 11 formed with the piezoelectric elements having the electrodes, the insularity can be secured, so that the piezoelectric elements 11 are normally actuated. In addition, any especial insulation treatment is not performed to the pressure generating element itself, thereby enabling to avoid useless cost-up.

The above mentioned embodiments are concerned with the recording head used to the ink jet-recording apparatus, but the liquid ejecting head according to the invention deals with not only the ink for the ink jet-recording apparatus but also ejects glue, manicure, conductive liquid (liquid metal).

What is claimed is:

1. A liquid ejecting head, comprising:

a passage unit, having a nozzle opening, a pressure generating chamber communicating with the nozzle opening, a reservoir holding a liquid to be supplying to the pressure generating chamber, and a vibrating plate closing openings of the pressure generating chamber and the reservoir;

a head case, on which the passage unit is attached; and a pressure generating element for applying variance of pressure to the pressure generating chambers, accommodated in a space defined in the head case, wherein an air sealing member contacts a surface of the head case and a surface of the pressure generating element to seal a gap between the head case and the pressure generating element so that a sealed space portion surrounded by the vibrating plate, the head case and the pressure generating element is formed, and wherein, when the liquid in the reservoir is vaporized, the vaporized liquid is passable through the vibrating plate.

2. The liquid ejecting head as set forth in claim 1, wherein a plurality of pressure generating elements are accommodated in the space of the head case.

3. The liquid ejecting head as set forth in claim 1, wherein the pressure generating element has an elongated shape in which a longitudinal direction thereof is parallel to a vibrating direction of the vibrating plate.

4. The liquid ejecting head as set forth in claim 1, wherein a space portion between an inside face of the space in the head case and the pressure generating element is formed to be narrow toward the side of the vibrating plate.

5. The liquid ejecting head as set forth in claim 4, wherein the air sealing member is disposed at a part of the space portion which becomes narrower.

6. The liquid ejecting head as set forth in claim 1, wherein the air sealing member is comprised of a low elastic material.

7. The liquid ejecting head as set forth in claim 6, wherein the low elastic material is a gelled material.

8. The liquid ejecting head as set forth in claim 1, wherein the air sealing member has insularity.

9. The liquid ejecting head as set forth in claim 1, wherein the liquid ejecting head is served for an ink jet recording apparatus.

10. The liquid ejecting head as set forth in claim 1, wherein the vibrating plate is comprised of a polyphenylene sulfide film.

* * * * *